US006924785B1

(12) United States Patent
Kretz et al.

(10) Patent No.: US 6,924,785 B1
(45) Date of Patent: Aug. 2, 2005

(54) METHOD AND APPARATUS FOR DISPLAYING DATA ON A MATRIX DISPLAY WITH AN ALTERNATING ORDER OF SCANNING IN ADJACENT GROUPS OF COLUMNS

(75) Inventors: Thierry Kretz, Saint Jean de Moirans (FR); Hugues Lebrun, Coublevie (FR); Bruno Mourey, Voiron (FR)

(73) Assignee: Thales Avionics LCD S.A., Paris (FR)

( * ) Notice: Subject to any disclaimer, the term of this patent is extended or adjusted under 35 U.S.C. 154(b) by 0 days.

(21) Appl. No.: 09/623,407

(22) PCT Filed: Mar. 9, 1999

(86) PCT No.: PCT/FR99/00524

§ 371 (c)(1),
(2), (4) Date: Oct. 19, 2000

(87) PCT Pub. No.: WO99/46753

PCT Pub. Date: Sep. 16, 1999

(30) Foreign Application Priority Data

Mar. 10, 1998 (FR) ..... 98 02919

(51) Int. Cl.[7] ..... G09G 3/28
(52) U.S. Cl. ..... 345/99; 345/103
(58) Field of Search ..... 345/87–103, 204–213, 345/690–691; 349/33–34, 151

(56) References Cited

U.S. PATENT DOCUMENTS 5,426,447 A * 6/1995 Lee ..... 345/103
5,606,194 A 2/1997 Lebrun et al.
5,781,171 A * 7/1998 Kihara et al. ..... 345/93
5,850,216 A * 12/1998 Kwon ..... 345/204
5,872,563 A * 2/1999 Asada ..... 345/212
5,880,707 A 3/1999 Aratani ..... 345/100
5,894,296 A * 4/1999 Maekawa ..... 345/98
6,020,871 A * 2/2000 Asada ..... 345/98
6,064,713 A 5/2000 Lebrun et al.
6,104,370 A * 8/2000 Nakagaki et al. ..... 345/100
6,177,920 B1 * 1/2001 Koyama et al. ..... 345/100
6,219,022 B1 * 4/2001 Yamazaki et al. ..... 345/103
6,359,608 B1 3/2002 Lebrun et al.

FOREIGN PATENT DOCUMENTS

| | | | |
|---|---|---|---|
| CA | 1 255 406 | | 11/1985 |
| DE | 3630779 | C1 * | 12/1992 |
| EP | 0186540 | | 7/1986 |
| EP | 9708553 | | 4/1996 |
| JP | 63-261326 | * | 10/1988 |
| JP | 07-264591 | * | 10/1995 |

* cited by examiner

*Primary Examiner*—Amr A. Awad
(74) *Attorney, Agent, or Firm*—Oblon, Spivak, McClelland, Maier & Neudstadt, P.C.

(57) ABSTRACT

The present invention relates to a process for displaying data on a matrix display consisting of N data lines and P selection lines at the intersections of which are situated the image points or pixels. The N data lines are grouped into P blocks if N' lines where N=P×N'. Each block receives in parallel one of the P' data signals which is demultiplexed on the N' lines of the said block. The scanning of the N' data lines of a block is carried out from 1 to N' or from N' to 1, alternately, according to the selection lines.

4 Claims, 3 Drawing Sheets

EPLD
10
CL
11
LINE COUNTER
12
(2)
Preset
15
COUNTER MODULO N'
CD
13
LINE MEMORY
14
CONTROL CIRCUIT
1
LCD
16
COUNTER DW
CDW
17
LEVEL SHIFTING CIRCUIT

METHOD AND APPARATUS FOR DISPLAYING DATA ON A MATRIX DISPLAY WITH AN ALTERNATING ORDER OF SCANNING IN ADJACENT GROUPS OF COLUMNS

BACKGROUND OF INVENTION

The present invention relates to a process for displaying data on a matrix display, more particularly a matrix display consisting of N data lines and M selection lines at the intersections of which are situated image points or pixels, and in which the N data lines are grouped into P blocks of N' data lines each.

Among matrix displays, the liquid crystal screens used in direct viewing mode or in projection mode are in particular known. These screens are, in general, composed of a first substrate comprising selection lines, hereinafter referenced lines, and data lines, hereinafter referenced columns, at the intersections of which are situated the image points and of a second substrate comprising a back electrode, the liquid crystals being inserted between the two substrates. The image points consist in particular of pixel electrodes connected across switching circuits, such as transistors, to the selection lines and the data lines. The selection lines and the data lines are respectively connected to peripheral control circuits generally referred to as "drivers". The line drivers scan the lines one after another and close the switching circuits, that is to say turn on the transistors of each line. On the other hand, the column drivers apply a cue to each data line, that is to say they charge the electrodes of the selected pixels and modify the optical properties of the liquid crystal contained between these electrodes and the back electrode, thus allowing the formation of images on the screen. When the matrix display comprises a limited number of lines and columns, each column is connected by its own connection line to the column drivers of the screen.

In the case of a screen with high definition, the principle of multiplexing is used between the outputs of the column driver and the columns of the screen in such a way as to reduce the number of tracks at the input of the cell. Thus, in French patent application No. 96 00259 filed on 11 Jan. 1996 in the name of the Applicant, there is described a column control circuit of a matrix display such as represented in FIG. 1. In this case, the columns are grouped into P blocks 1 of N' columns, i.e. 9 columns C1, C2, C3 . . . C9 in the embodiment represented. Each block consists of transistors 3, one of the electrodes of which is linked to a column and the other electrode of which is connected to the same electrode of the other transistors of the block, together these electrodes being connected to a video input referenced DB1 for the first block, DB2 for the second block, DBP for the last block. The gates of the transistors 3 each receive a demultiplexing signal DW1, DW2, DW3 . . . DW9. Each block exhibits the same structure.

The timing diagrams for the voltages read off from the successive columns of one and the same block 1 receiving a video signal DB1 to DBP are represented in FIG. 2. In plotting these timing diagrams it has been assumed that the DC and AC voltage errors introduced by column-line-column coupling (referenced 2 in FIG. 1), the origin of which was described in French patent No. 96 00259 filed on 11 Jan. 1996, are perfectly corrected by the compensation circuit presented in this same patent. Each timing diagram represents a line time of a given column (1 to 9) of a block connected for example to DB1. In the case of a line time of 32 μs, the signals can be broken down as follows:

| | | |
|---|---|---|
| 1. | Precharging of all the columns of the matrix | 4 μs |
| 2. | Stabilization of the precharge | 0.5 μs |
| 3. | Sampling of the video over the 9 columns of the block DB | 9 × 2 μs |
| 4. | Equalization between column and pixel | 7.5 μs |

These diagrams show that the voltage of the columns and hence the RMS voltage across the terminals of the liquid crystal cell, the electrodes of which are respectively the column and the electrode CE opposite, changes according to the order of sampling of the columns of a block connected to DBP. Now, since the dielectric constant of the liquid crystal varies as a function of the voltage applied to its terminals, the columns of one and the same block receiving a signal DBi do not therefore exhibit the same charging capacity. Consequently, the coupling between the gates of the sampling transistors and the columns of one and the same block receiving the signal DBi increases as a function of the order of sampling of the columns, this introducing a DC error of several tens of mV between the first column sampled in the block receiving the signal DBi and the last.

The purpose of the present invention is to propose a process for displaying data on a matrix display which makes it possible to remedy this drawback.

SUMMARY OF THE INVENTION

Accordingly, the subject of the present invention is a process for displaying data on a matrix display consisting of N data lines and M selection lines at the intersections of which are situated the image points or pixels, and in which the N data lines are grouped into P blocks of N' data lines each (N=P×N'), each block receiving in parallel one of the P data signals which is demultiplexed on the N' lines of the said block, characterized in that, alternately according to the selection lines, the scanning of the N' data lines of a block is carried out from 1 to N' or from N' to 1.

According to one embodiment of the present invention, the scan from 1 to N' then from N' to 1 is carried out every second selection line.

According to another embodiment which makes it possible to obtain the same continuous level on all the columns, the scan from 1 to N' then from N' to 1 is carried out for four successive selection lines, the scan being carried out in a first direction for two successive selection lines and in a second direction for the other two succeeding selection lines.

The present invention also relates to a circuit for implementing the above process. This circuit consists of at least one programmable logic circuit associated with a line counter determining the reversal of the direction of scan.

BRIEF DESCRIPTION OF THE DRAWINGS

Other characteristics and advantages of the present invention will become apparent from reading the description given hereinbelow, this description being given with reference to the drawings appended hereto in which.

DETAILED DESCRIPTION

To simplify the description hereinbelow, in the figures the same elements bear the same references.

Figure 1:
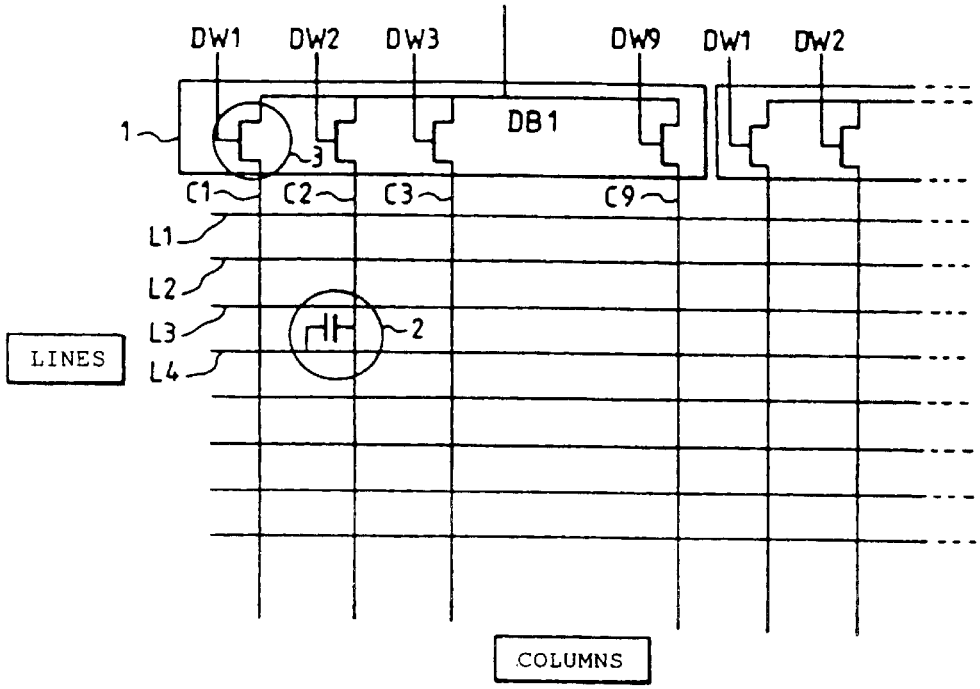
FIG. 1 already described is a schematic representation of a matrix display in which the columns are grouped into blocks, and which will be used for the implementation of the present invention.
Figure 2:
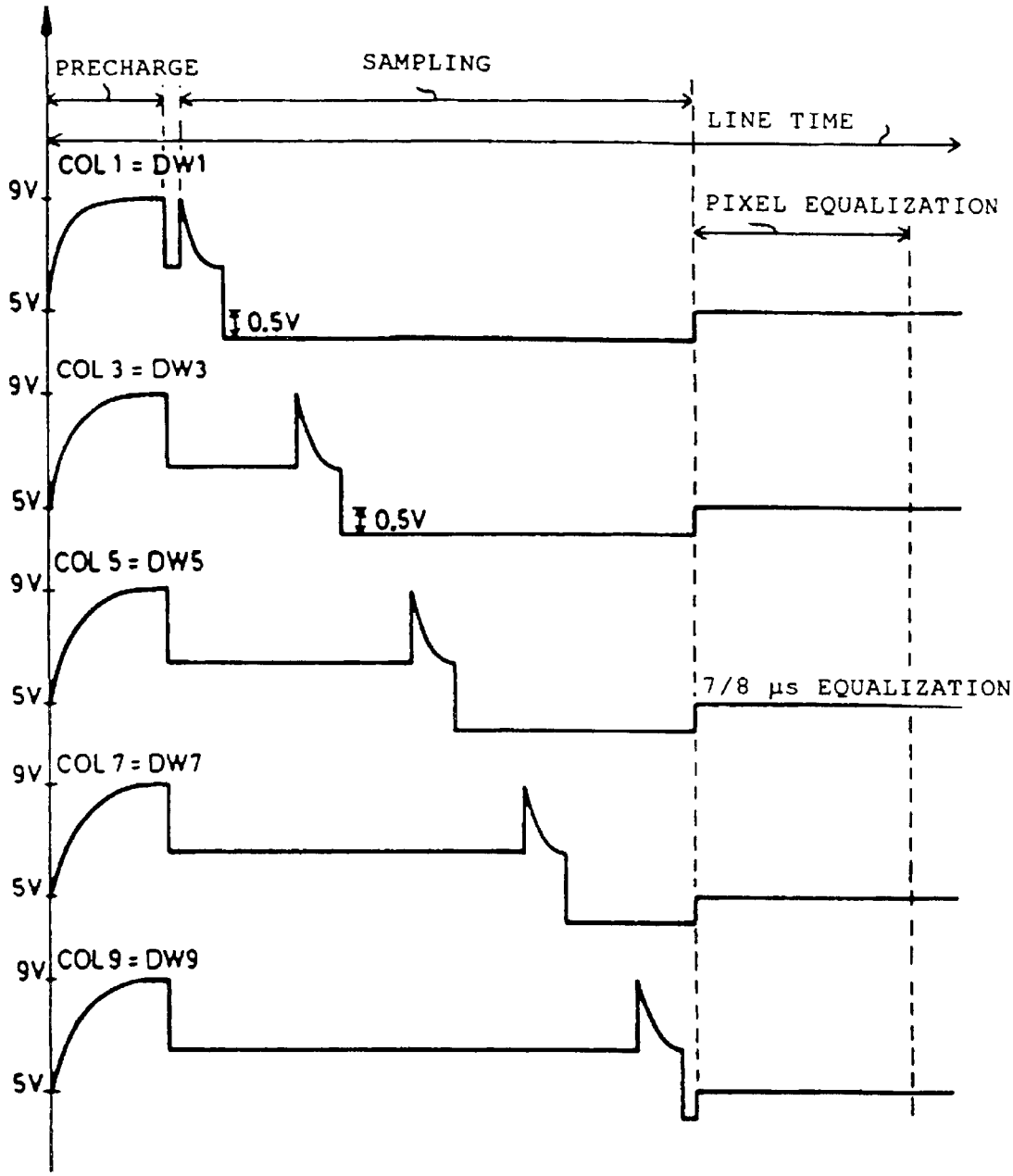
FIG. 2, already described, represents the timing diagrams, over a line time, of the odd numbered columns of a block DB consisting of 9 columns.

The process in accordance with the present invention is applied chiefly to a matrix display of the type represented in FIG. 1. This display consists of N data lines or columns and M selection lines at the intersections of which are situated the image points or pixels (not represented). The N columns are grouped into P blocks 1 of N' columns each. By way of example, in FIG. 1 is represented a block of 9 columns. Usually for a screen used for a video display, the column control circuit will contain 80 blocks of 9 adjacent columns and will operate with a sampling frequency of around 500 kHz. As represented in FIG. 1, each block 1 receives in parallel one of the P or 80 data signals which is demultiplexed by the signals DW1 to DW9 on the N' or 9 columns of a block. In accordance with the present invention, to avoid the DC error between the columns of one and the same block, due to the coupling between the gate of the sampling transistor and the column, which error changes as a function of the order of sampling of the columns, for the selection line L1, each block 1 is scanned successively from line C1 to C9 by applying sampling pulses DW1 to DW9, and signals such as represented in FIG. 2 are obtained on each column C1 to C9. Then, for the next line L2 each block is scanned, beginning from column C9, towards column C1 by applying sampling pulses from DW9 to DW1 in such a way as to reduce the DC error as explained in the introduction with reference to FIG. 2.

According to a variant embodiment of the process which makes it possible to obtain the same continuous level on all the columns, the scan is reversed by reversing the arrival of the sampling pulses every second line out of four lines according to the following table:

| Line | Frame 1 | Frame 2 | Frame 3 |
|---|---|---|---|
| 1 | DW1 to 9 | DW1 to 9 | DW1 to 9 |
| 2 | DW1 to 9 | DW1 to 9 | DW1 to 9 |
| 3 | DW9 to 1 | DW9 to 1 | DW9 to 1 |
| 4 | DW9 to 1 | DW9 to 1 | DW9 to 1 |
| 5 | DW1 to 9 | DW1 to 9 | DW1 to 9 |
| 6 | DW1 to 9 | DW1 to 9 | DW1 to 9 |

It should be noted in the above table that, unlike what happens with the video data which are reversed on the image points from one frame to another so as to avoid the marking of the cell, the direction of scanning of the signals DWj is preserved from one frame to another for a given selection line so as to avoid the AC error which would result therefrom.

The present invention also relates to a circuit making it possible to implement this process. This circuit consists of at least one programmable logic circuit associated with a line counter determining the reversal of the direction of scan.

Figure 3:
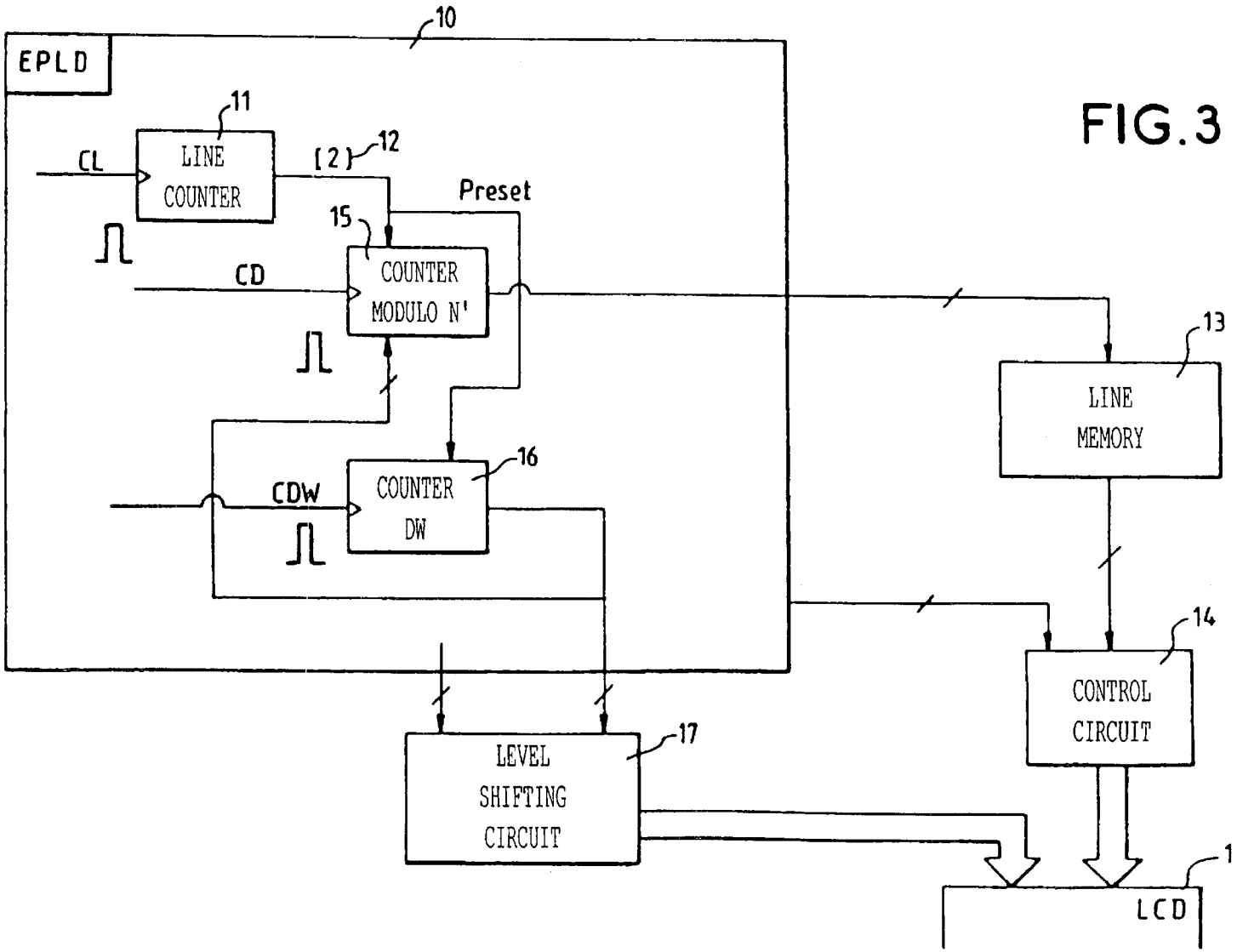
FIG. 3 is a schematic representation of a circuit used to implement the present invention.

An exemplary circuit making it possible to generate the scan of each block receiving the demultiplexing signals DW1 to DWN' from 1 to N' then from N' to 1 every 2 lines is represented in FIG. 3. This circuit is based on a programmable logic circuit EPLD 10 which governs the order of dispatch of the video data (DB) to the cell and the direction of scan of the signals DW (j=1 to N') in a block receiving a given signal DB (i=1 to P) according to the bit of rank 2 of the address at the output of the line counter (11) in the case of the example represented; that is to say:

if the bit of rank 2 at the output of the line counter (11) equals 0 (xxxxxx00 or xxxxxx01), the words DWj' are read from 1 to N' and the P video data, stored in the line memory 13, are transferred to a D/A control circuit 14, i.e. a digital/analogue converter upstream of the cell in the order of the DWs according to the table below:

| DW | DB | Column number |
|---|---|---|
| 1 | k<br>with k integer and<br>$1 \leqq k \leqq P$ | $N' \times (k-1)+1$<br>with k integer and<br>$1 \leqq k \leqq P$ |
| 2 | k<br>with k integer and<br>$1 \leqq k \leqq P$ | $N' \times (k-1)+2$<br>with k integer and<br>$1 \leqq k \leqq P$ |
| N' | k<br>with k integer and<br>$1 \leqq k \leqq P$ | $N' \times (k-1)+N'$<br>with k integer and<br>$1 \leqq k \leqq P$ |

otherwise the words DWj are read from N' to 1 and the P video data are transferred to the D/A control circuit 14 in the order indicated in the table below:

| DW | DB | Column number |
|---|---|---|
| N' | k<br>with k integer and<br>$1 \leqq k \leqq P$ | $N' \times (k-1)+N'$<br>with k integer and<br>$1 \leqq k \leqq P$ |
| 2 | k<br>with k integer and<br>$1 \leqq k \leqq P$ | $N' \times (k-1)+2$<br>with k integer and<br>$1 \leqq k \leqq P$ |
| 1 | k<br>with k integer and<br>$1 \leqq k \leqq P$ | $N' \times (k-1)+1$<br>with k integer and<br>$1 \leqq k \leqq P$ |

In more detail, the signal referenced Preset at the output of the line counter 11 controlled by the line clock CL is dispatched respectively to a counter modulo N' 15 and to a counter DW 16. The counter modulo N' 15 is controlled by the data clock CD and operates so that:

| | |
|---|---|
| If Preset = 0 | the video data are transferred as they are. |
| If Preset ≠ 0 | N' + 1 - the video data are transferred. |

Likewise, the counter DW 16 is controlled by the clock of the DWs DWC and operates as follows:

| | |
|---|---|
| If Preset = 0 | the words are transferred in the normal order. |
| If Preset ≠ 0 | the words are transferred in the reverse order. |

This cue at the output of the counter DW is dispatched to a level shifting circuit 17 and returned to the counter modulo N' 15.

It is obvious to the person skilled in the art that this is merely one particular embodiment which can be modified without departing from the claims.

What is claimed is:

1. Process for displaying data on a matrix display having N data lines and P selection lines at the intersections of which are situated the image points or pixels, and in which the N data lines are grouped into P blocks of N' data lines each (N=P×N'), each block receiving in parallel one of the P data signals which is demultiplexed on the N' lines of said block, wherein, alternately, according to the selection lines, the scanning of the N' data lines of a block is carried out from 1 to N' and from N' to 1, wherein a scanning direction is controlled as a function of the selection line to provide a temporal average of a column.

2. Process according to claim 1, wherein the scan from 1 to N' then from N' to 1 is carried out every second selection line, the scan being carried out in a first direction for a first selection line and in a second direction for a succeeding selection line.

3. Process according to claim 1, characterized in that the scan from 1 to N' then from N' to 1 is carried out for four successive selection lines, the scan being carried out in a first direction for two successive selection lines and in a second direction for the other two succeeding selection lines.

4. Circuit for implementing the process according to any one of claims 1 to 3, characterized in that it consists of at least one programmable logic circuit associated with a line counter determining the reversal of the direction of scan.

* * * * *